US007214109B2

(12) United States Patent
Lappöhn

(10) Patent No.: US 7,214,109 B2
(45) Date of Patent: May 8, 2007

(54) ONE-PIECE MULTI-SHANK CONTACT SPRING FOR MINIATURE PLUG CONNECTORS

(75) Inventor: Jürgen Lappöhn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/262,597

(22) Filed: Oct. 31, 2005

(65) Prior Publication Data

US 2006/0121798 A1 Jun. 8, 2006

(30) Foreign Application Priority Data

Oct. 30, 2004 (DE) ..... 10 2004 0527121

(51) Int. Cl.
*H01R 13/11* (2006.01)

(52) U.S. Cl. ..... 439/851; 439/861

(58) Field of Classification Search ..... 439/833, 439/839, 842, 843, 850–857, 861, 862, 877, 439/885, 886
See application file for complete search history.

(56) References Cited

U.S. PATENT DOCUMENTS 612,123 A * 10/1898 Schwedtmann ..... 439/825
3,188,606 A * 6/1965 De Lyon et al. ..... 439/850
4,653,987 A 3/1987 Tsuji et al.
4,934,965 A 6/1990 Buddrus et al.
5,281,175 A 1/1994 Chupak et al.
5,733,154 A * 3/1998 Libregts ..... 439/850
6,039,615 A * 3/2000 Suzuki ..... 439/849
6,475,041 B1 11/2002 Lappöhn et al.
2004/0142598 A1* 7/2004 Lappohn ..... 439/607
2006/0121798 A1* 6/2006 Lappohn ..... 439/851

FOREIGN PATENT DOCUMENTS

DE 33 24 737 C2 1/1985
DE 38 17 803 C3 5/1988
DE 43 30 390 C2 9/1993
WO WO1989/005531 A1 6/1989
WO WO1998/035404 A1 8/1998

* cited by examiner

*Primary Examiner*—James R. Harvey
(74) *Attorney, Agent, or Firm*—Collard & Roe, P.C.

(57) ABSTRACT

A one-piece, multi-shank contact spring for miniature plug connectors, particularly for high-frequency signals, having a region that contacts a plug-in lead. The contacting region (A) extends all the way to the free end of a plugged-in plug-in lead.

10 Claims, 6 Drawing Sheets

ONE-PIECE MULTI-SHANK CONTACT SPRING FOR MINIATURE PLUG CONNECTORS

BACKGROUND OF THE INVENTION

1. Field of the Invention

The invention relates to a one-piece, multi-shank contact spring for miniature plug connectors, particularly for high-frequency signals.

2. The Prior Art

A one-piece, multi-shank contact spring for miniature plug connectors is described in DE 43 30 390 C2. The contact spring, which is continuously punched from a metal strip and bent, carries two spring shanks, the free ends of which form two contact cones that lie opposite one another, as well as a contact intake for a contact blade. The contact intake is offset laterally and rotated by 90° relative to the planar spring shanks, and for this reason, even extremely long contact blades can be used. The contact blade is pushed in between the intake cones and the contact cones as the connection is made, all the way to a stop. This method of construction is particularly well suited for multi-point plugs having small raster intervals.

A one-piece contact spring having two spring shanks that lie opposite one another, for the press-in technique, is described in German Patent No. DE 33 24 737 C2.

There are also one-piece contact springs that form a more or less closed cage for a contact blade or contact pin (German Patent No. DE 38 17 803 C3, European Patent No. EP 0 390 865 B1, European Patent No. EP 0 958 638 B1, U.S. Pat. No. 5,281,175). However, the latter terminals are not completely in line with the current trend in the industry, that of increasing the density of the electrical signal connections and thereby saving space and costs.

All of the contact springs indicated above have the disadvantage that the contact-forming region between the contact spring and a plug-in lead, including, for example, flat contact blades, square or round contact pins, and circuit board leads, is directed at a point-shaped or line-shaped zone of contact points that lie opposite one another, and this does not meet any needs for for a higher current carrying capacity and, in particular, for high-frequency applications of a plug connector. This is because for high-frequency signals, aside from a reliable mechanical and electrical connection, an impedance adaptation, and reciprocal shielding of the contact springs of a plug relative to one another, it would be desirable to also reduce or completely avoid the negative effects of reflections on the electrical transmission behavior of a plug connector. These effects are caused by the fact that a signal component runs beyond the contact zone all the way to the tip of a plug-in lead, and is reflected there. In this way, the input signals are split up starting from the plug connector, and a running time difference that is dependent on the free length of the plug-in lead is imposed on part of the signals, which difference can result in such signal impairments as echo and signal weakening in the further transmission path. On the other hand, however, the insertion length of a plug-in lead into a contact spring cannot simply be reduced as desired, because in this way, reliable contacting and parallel intake of the plug-in lead into a contact spring, which also has an insertion and guide function for the plug-in lead, would suffer. This is particularly true for multi-pole electrical miniature plug connectors, as they are used, for example, in communications technology and computer technology. If, on the other hand, the contacting of plug connectors were to be placed at the end of the plug-in leads, the contact reliability is no longer guaranteed, due to unavoidable tolerances, since the contact spring would only be allowed to just touch the tip of the plug-in lead, in order to prevent reflections.

SUMMARY OF THE INVENTION

It is therefore an object of the invention to create a plug connector, particularly for high-frequency applications, which does not have these disadvantages. In particular, it is an object of the invention to prevent signal reflections at the free end of a plug-in lead, such as a circuit board lead, contact blade, or contact pin. Furthermore, it is an object to improve the contact reliability and current carrying capacity.

This object is accomplished, according to the invention, by a one-piece, multi-shank contact spring for miniature plug connectors, particularly for high-frequency signals, having a region that contacts a plug-in lead. The connecting region extends all the way to the free end of the plugged-in plug-in lead.

The one-piece, multi-shank contact spring preferably has a U-shaped to cage-like (open square) cross-sectional shape, and the spring shanks of the contact spring preferably form spring-like contacting segments over their contacting length. The spring shanks are preferably have recesses extending all the way into the spring base, at intervals over the length of the contacting region.

The recesses are preferably trapezoid in shape. The larger base sides of the recesses preferably face the free ends of the spring shank. The recesses are preferably rounded in the region of the spring base.

There are insertion ridges for a plug-in lead that are bent away at the insertion end of the U-shaped contact spring. The insertion ridges run towards one another.

The contact spring is preferably bent in a cage-like manner, but without overlaps.

In another embodiment, the recesses lie opposite one another in pairs, in each instance. There are two to six pairs of recesses disposed over the length of the contact spring.

There may be a board lead piece that follows the contacting part.

The contact spring is preferably adapted structurally to a contact pin or to a contact blade.

In another embodiment, there may be a plurality of parallel contact springs embedded in a contact spring housing.

The plug connector is preferably produced and designed for high-frequency applications with regard to impedance.

According to the invention, reflections of HF signals at the tip of a plug-in lead, and therefore running time differences, are avoided in that a longer contacting region of a plug connector leads to the free end of a plugged-in plug-in lead.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
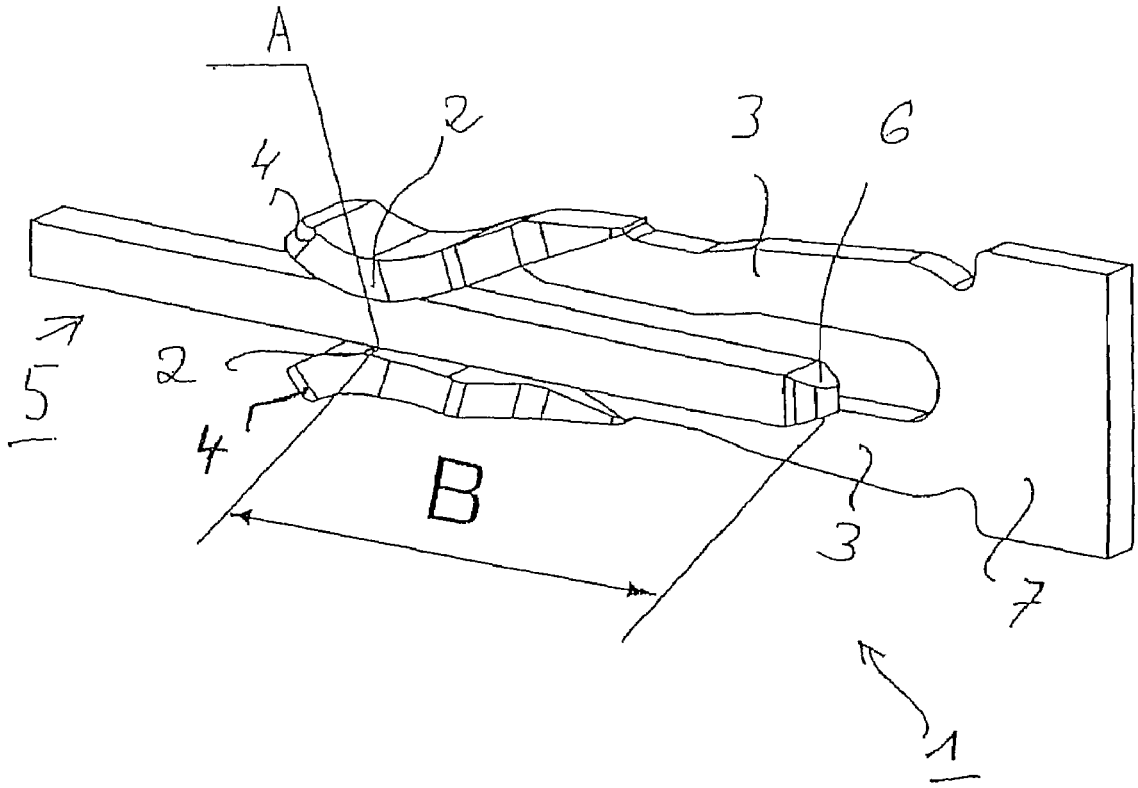
Fig. 1 Prior Art
FIG. 1 shows a plug-in connector according to the state of the art.

First, the disadvantages of a conventional miniature connector for high-frequency signals will be presented using FIG. 1. The one-piece, two-shank contact spring 1 carries contacting points 2 that lie opposite one another as a mirror image, in the form of contact cones at the free ends of the spring shank 3, which at the same time form an intake zone 4 for a plug-in lead, which is configured here as a contact pin 5 that is square in cross-section. For mechanically and electrically reliable contacting A with the contact pin 5, and in the interests of a parallel lead of the contact spring 1 to the contact pin 5, particularly when there are a plurality of parallel contact springs 1 in a spring housing not shown in greater detail, it is necessary, for reasons of mastering tolerances, that the point-shaped or line-shaped contacting A is not produced directly at the free top 6 of the contact pin 5, but rather at a certain interval B behind it. For high-frequency signals in GHz range, however, this has the effect that the HF signal splits up at the plug connector. One signal component flows away directly via the contact cones 2, the spring shanks 3, and a board lead part 7, in the contacting region A. The other signal component flows past the contact cones 2 all the way to the tip 6 of the contact pin 5, is reflected at the tip 6, and only then flows away via the contacting region A, the spring shanks 3, and the board lead part 7. This results in running time differences and therefore different zero phases between components of one and the same signal. The phase shift brings about the effect that because of the uncorrelated signal superimposition, signal distortions such as signal echoes or signal attenuations occur. In the case of an extremely disadvantageous signal running-time difference and signal carrier frequency, signal extinction can actually occur due to these so-called interferences, namely if a phase shift of the two signal components that approaches 180° occurs.

While these effects can still be tolerated in digitalized voice traffic, thanks to suitable voice signal processing, the situation in bit-oriented data traffic is much more critical, and for this reason, a number of test and redundancy measures, which consume transmission resources, is required in data traffic.

Figure 2:
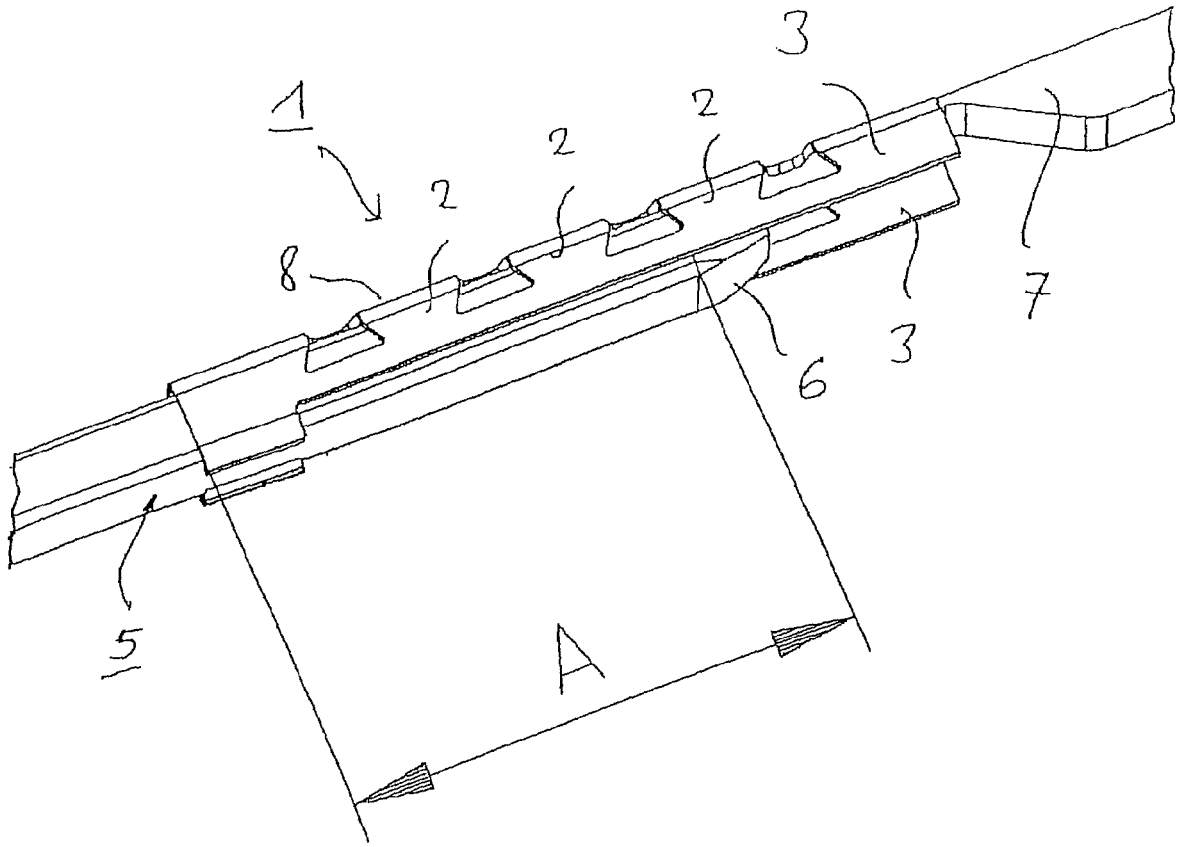
FIG. 2 shows a plug-in connector according to the invention, consisting of a contact spring and a plug-in lead.
Figure 2A:
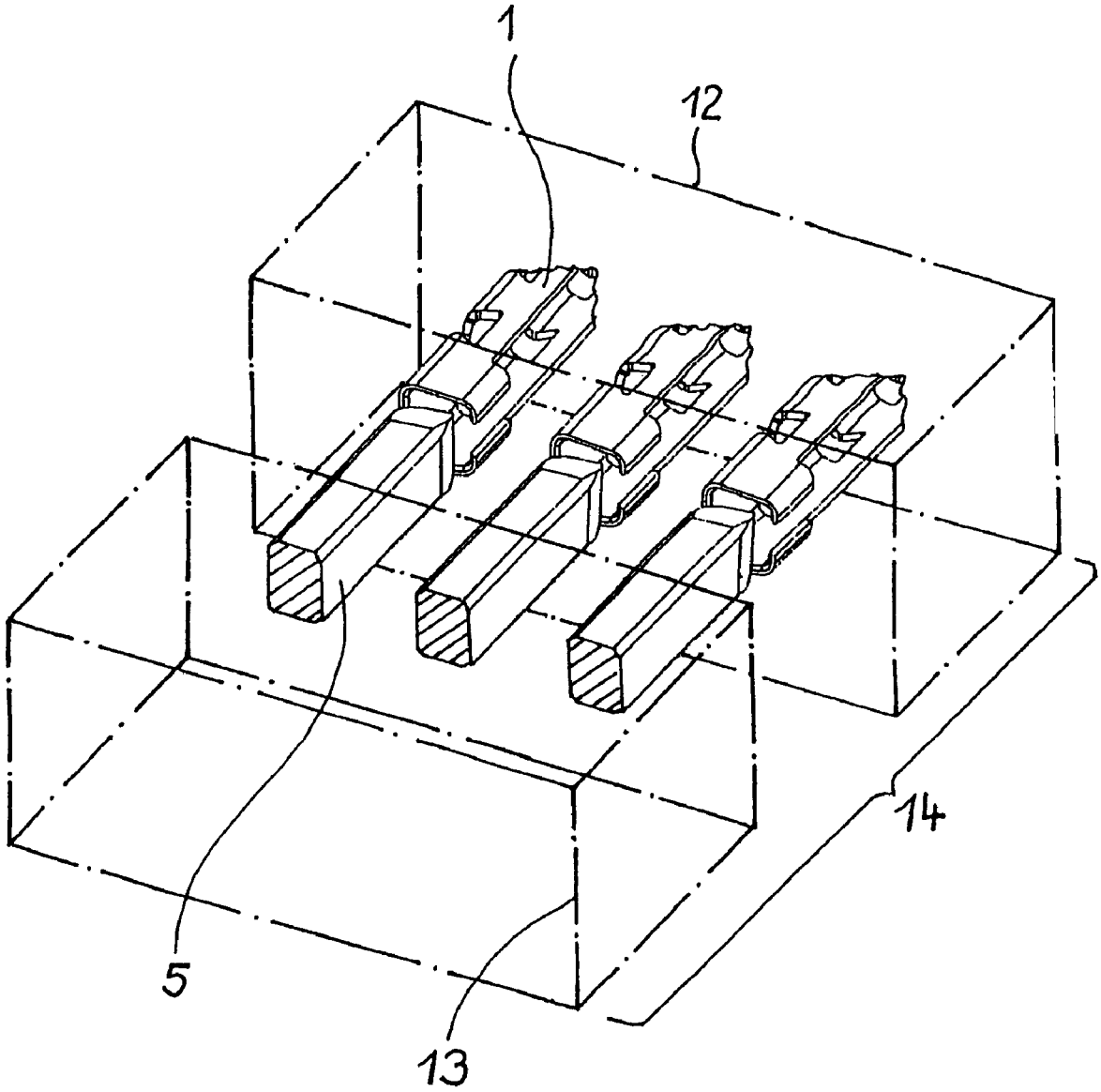
FIG. 2A shows several springs according to the invention in a spring housing.

The invention avoids these consequences, as will be explained in greater detail below, using FIG. 2. FIG. 2 shows the lead of an extended U-shaped contact spring 1 with a plug-in lead, here again a contact pin 5 that is approximately square in cross-section. The plug connector could be dimensioned just as well, for example, for a contact blade, a round contact pin, or a circuit board lead. Contact spring 1 has a spring base 8, from which two spring shanks 3 are angled away on both sides. Spring base 8 makes a transition into a board lead part 7, by way of which the HF signals are passed on. Spring shanks 3 are divided up into several contacting points 2 over the entire insertion or contacting region A, and therefore a plugged-in contact pin 5 contacts contact spring 1 at several points, particularly, however, all the way to its tip 6. As a result, several advantages are achieved. For one thing, excellent lateral guidance of contact pin 5. In a multi-pole female plug 12 of a plug connector 14 having new contact springs 1 arranged at a distance to each other (see FIG. 2A), the contact pins 5 of male plug 13 will therefore be oriented strictly parallel, and this not only mechanically relieves stress on the plug connector, but also clearly improves the transmission characteristics, such as reflection behavior and inductive disturbance between the individual lines. It furthermore improves the contact reliability, in that several contacting points are distributed over the insertion length. Furthermore, the current carrying capacity of a plug connector increases in linear manner with the number of contacting points per plug connector. It is true that the signal currents, particularly in the HF range, are not particularly great in and of themselves, but rather they are a variable that should be taken into consideration, in view of the required miniaturization of technology in areas such as communications technology, computer technology, space technology, medical technology, etc. In particular, however, reflection of signal components at tip 6 is precluded by contacting a plug-in lead at its tip 6. In this way, undesirable reflections, refractions, scattering and attenuation of HF signals within a plug connector are prevented.

Figure 3:
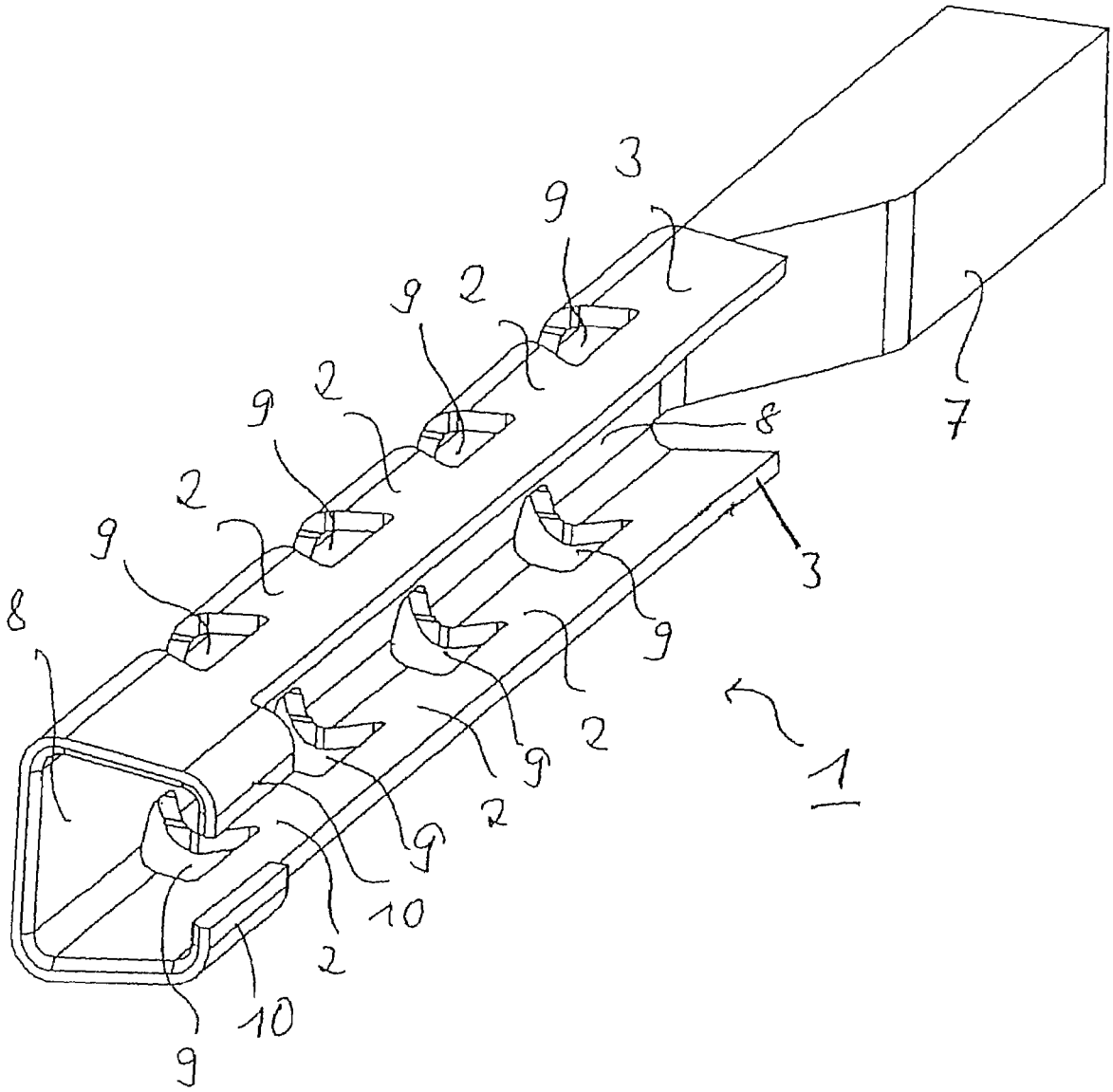
FIG. 3 shows a contact spring with a board lead piece, in a perspective side view.

In FIG. 3, a single contact spring 1 is shown in a perspective side view. The reference symbols are identical with those in FIG. 2, as also in the other figures. Spring base 8 can be seen, from which the two spring shanks 3 are bent away. The bending angle is slightly more than 90°, so that the two spring shanks 3 run at a slight slant towards one another, and can exert spring force on contact pin 5. The contacting points 2 are formed in that spring shanks 3 have a series of recesses 9 between them. In this way, each contacting point 2 thereby applies its own spring force or contacting force. Recesses 9 are slightly trapezoid in shape, whereby the smaller base line of recess 9 reaches into spring base 8, thereby improving the spring effect, and the larger base line ends ahead of the free ends of spring shanks 3. Preferably, recesses 9 are rounded in the region of spring base 8, thereby counteracting any tendency of the spring material to tear under stress. In the example, four recesses 9, in each instance, are disposed over the entire contacting region A of the contact spring 1, in spring shanks 3, which stand opposite one another in pairs. Spring base 8 makes a transition to board lead part 7 at one end. The latter can form a track in itself, or can serve to connect a track or another electrical component. At the free end of contact spring 1, two insertion ridges 10 are additionally provided as an insertion aid for the contact pin. Insertion ridges 10 simultaneously improve the mechanical strength of the plug connector.

Figure 4:
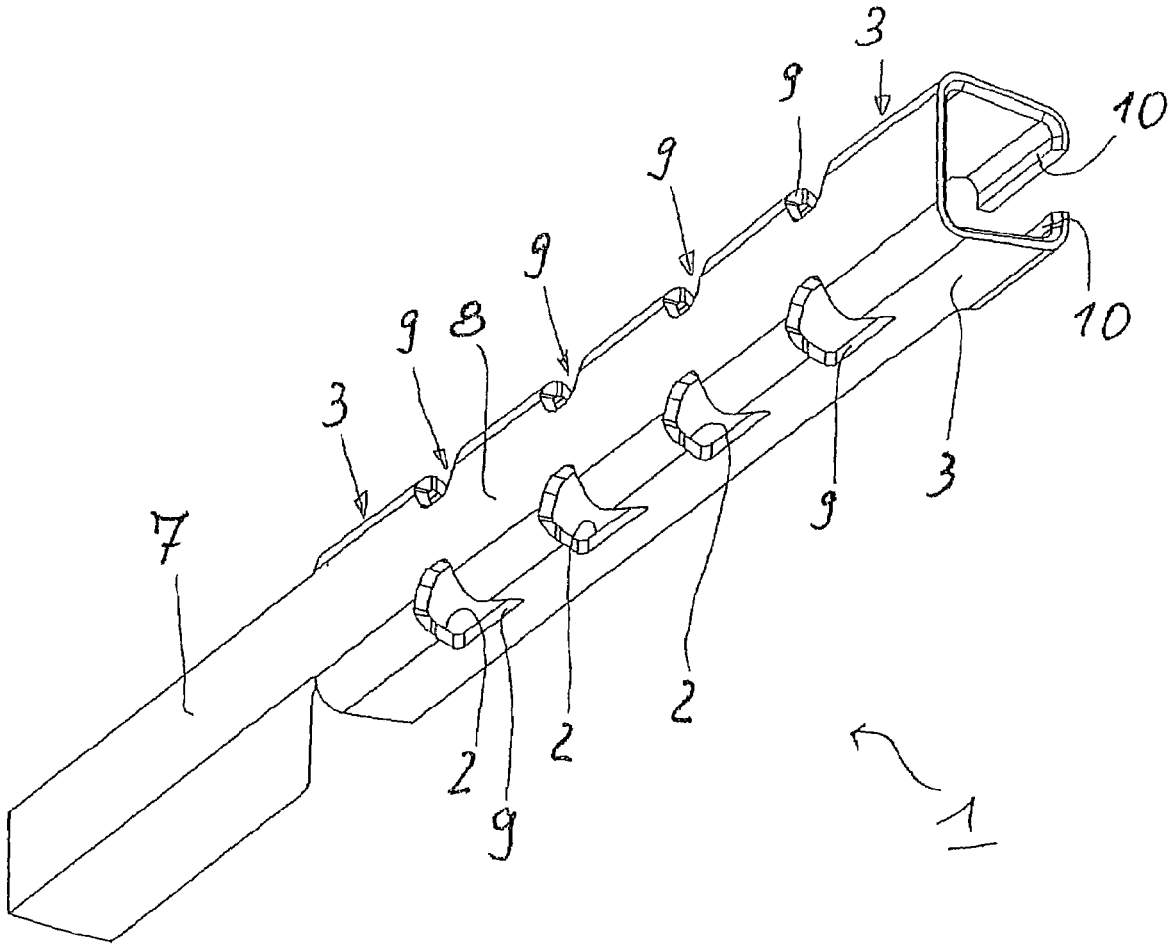
FIG. 4 shows the contact spring with the board lead piece, in a perspective rear view.

In FIG. 4, contact spring 1 according to the previous figures is shown once again, with a perspective view from the rear. The board lead part is referred to as 7, the spring base as 8. One can see rounded recesses 9 made in spring base 8, which continue far into free spring shanks 3, opposite one another. At the free end of contact spring 1, insertion ridges 10 are bent away from spring shanks 3. Contacting points 2 lie along spring shank 3, between recesses 9.

Figure 5:
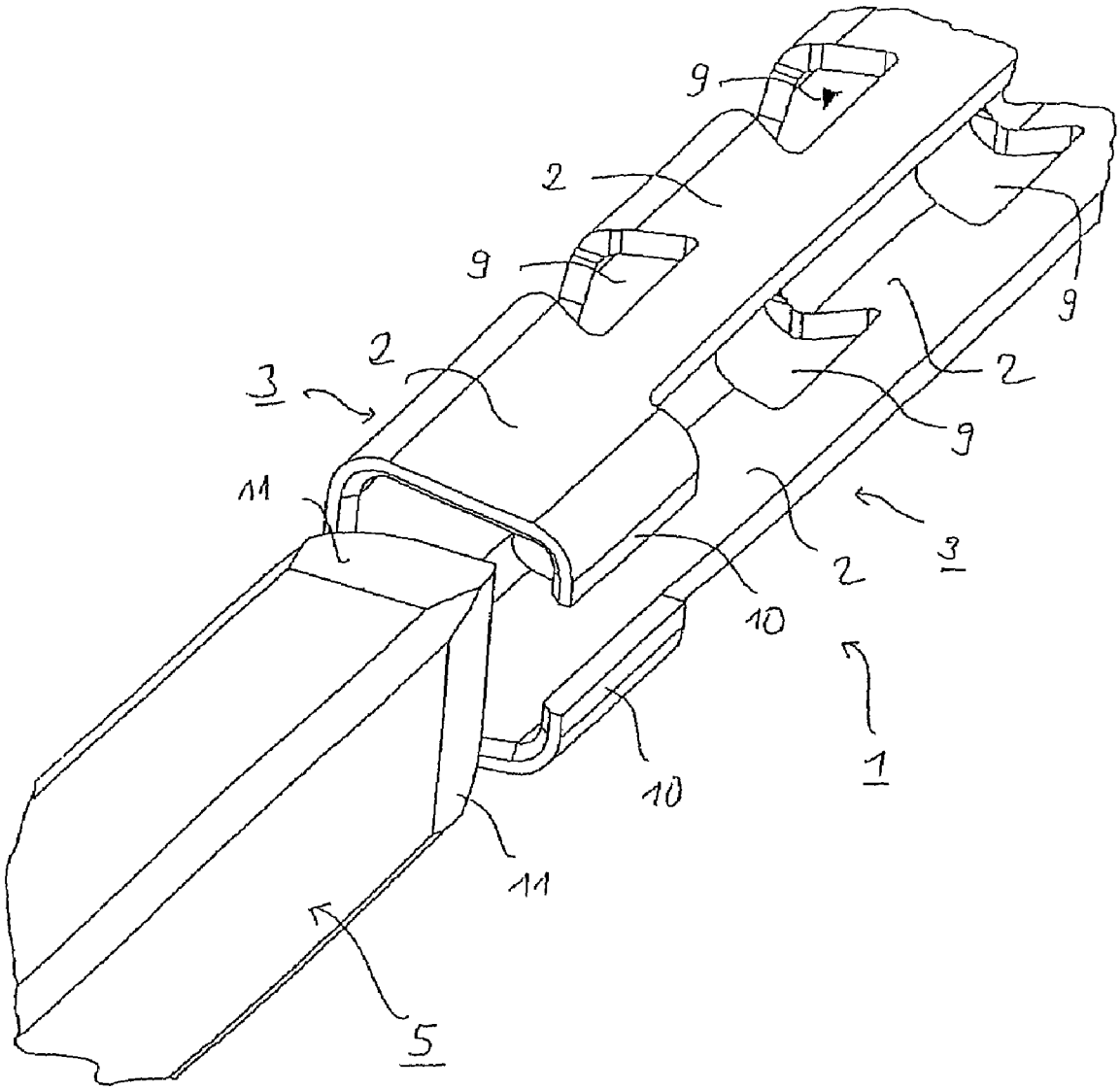
FIG. 5 shows details of an intake zone of the plug connector.

The insertion end of a contact spring 1 is particularly clearly evident in FIG. 5. Contact pin 5 is beveled on all sides, thereby obtaining a short insertion nose 11. Insertion nose 11 finds contact spring 1 equipped with guide ridges 10 when connection takes place.

Accordingly, while only a few embodiments of the present invention have been shown and described, it is obvious that many changes and modifications may be made thereunto without departing from the spirit and scope of the invention.

REFERENCE SYMBOLS

1 contact spring
2 contacting point
3 spring shank
4 intake zone
5 contact pin, generally plug-in lead
6 tip of the contact pin
7 board lead part
8 spring base
9 recess
10 guide ridge
11 insertion nose
A contacting (region)
B interval

What is claimed is:

1. A one-piece, multi-shank contact spring for miniature plug connectors, said spring having a U-shaped or open-square shaped cross section, said spring having spring shanks having an electrical contact region formed by contact points that contact a plug-in lead along an entire length of said spring shanks, said electrical contact region extending to a free top of the plug-in lead when said plug-in lead is plugged into the contact spring, wherein the spring shanks have recesses extending all the way through into a spring base of the spring, said recesses being disposed at intervals over a length of the electrical contact region, and wherein the recesses lie opposite one another in pairs.

2. A one-piece, multi-shank contact spring according to claim 1, wherein the recesses are trapezoidal in shape, and wherein larger base sides of the recesses face free ends of the spring shank.

3. A one-piece, multi-shank contact spring according to claim 2, wherein the recesses are rounded in a region of the spring base.

4. A one-piece, multi-shank contact spring according to claim 1, wherein the contact spring is bent to have a U-shaped cross section, and further comprising insertion ridges for the plug-in lead, said insertion ridges being bent towards one another.

5. A one-piece, multi-shank contact spring according to claim 1, wherein the contact spring is bent to have an open square-shaped cross section.

6. A one-piece, multi-shank contact spring according to claim 1, wherein there are two to six pairs of recesses disposed over the length of the contact spring.

7. A one-piece, multi-shank contact spring according to claim 1, further comprising a board lead piece adjacent the contacting region.

8. A one-piece, multi-shank contact spring according to claim 1, wherein the contact spring is adapted structurally to be used with a plug-in lead that comprises a contact pin or a contact blade.

9. An assembly comprising a spring housing and a plurality of one-piece multi-shank contact springs according to claim 1 embedded parallel with one another in said spring housing.

10. A one-piece, multi-shank contact spring according to claim 1, wherein the spring comprises a plug connector designed for high-frequency applications.

* * * * *